US007195558B1

(12) United States Patent
Perez

(10) Patent No.: US 7,195,558 B1
(45) **Date of Patent: *Mar. 27, 2007**

(54) BOARD GAME AND METHOD OF PLAY

(76) Inventor: Denise E. Perez, 4309 Alta Dr., Las Vegas, NV (US) 89107

( * ) Notice: Subject to any disclaimer, the term of this patent is extended or adjusted under 35 U.S.C. 154(b) by 787 days.

This patent is subject to a terminal disclaimer.

(21) Appl. No.: 10/453,911

(22) Filed: Jun. 2, 2003

Related U.S. Application Data

(63) Continuation-in-part of application No. 10/124,058, filed on Apr. 15, 2002, now Pat. No. 6,572,109, which is a continuation-in-part of application No. 09/455, 335, filed on Dec. 6, 1999, now abandoned.

(51) Int. Cl.
*A63F 13/06* (2006.01)

(52) U.S. Cl. ..... 463/9; 273/237

(58) Field of Classification Search ..... 463/9, 463/42; 273/237, 241
See application file for complete search history.

(56) References Cited

U.S. PATENT DOCUMENTS 4,147,359 A 4/1979 King
4,666,162 A 5/1987 Campbell
4,946,168 A 8/1990 Fauls
5,004,245 A 4/1991 Schumacher et al.
5,087,050 A * 2/1992 Donovan ..... 273/237
5,126,717 A * 6/1992 Renaud et al. ..... 340/323 R
5,240,249 A * 8/1993 Czarnecki et al. ..... 463/11
5,660,388 A 8/1997 Benn
6,126,717 A 10/2000 Gauthier et al.
6,572,109 B2 * 6/2003 Perez ..... 273/237

* cited by examiner

*Primary Examiner*—Xuan M. Thai
*Assistant Examiner*—Alan Cross
(74) *Attorney, Agent, or Firm*—Rob L. Phillips; Greenberg Traurig

(57) ABSTRACT

A game of reasoning having a triangular game board is disclosed. Players are given a pre-defined time limit to respond to questions based on scenarios likely to be encountered by the game's preferred teenage players. Points and penalties correspond to the selected responses. By correctly responding, players advance from a base of the game board to a zenith thereof. Once all players of a participating team reach the zenith, that team is declared the winner. Responses to questions are input by means of a game pad. The game board is formed of independent blocks stacked in a triangular shape divided into two sides. Each block includes at least one viewable face sectioned into equal parts corresponding to the number of team players. The sections include means of unique color illumination such that the progress of each player can be monitored. The game is also playable in a computer environment.

25 Claims, 2 Drawing Sheets

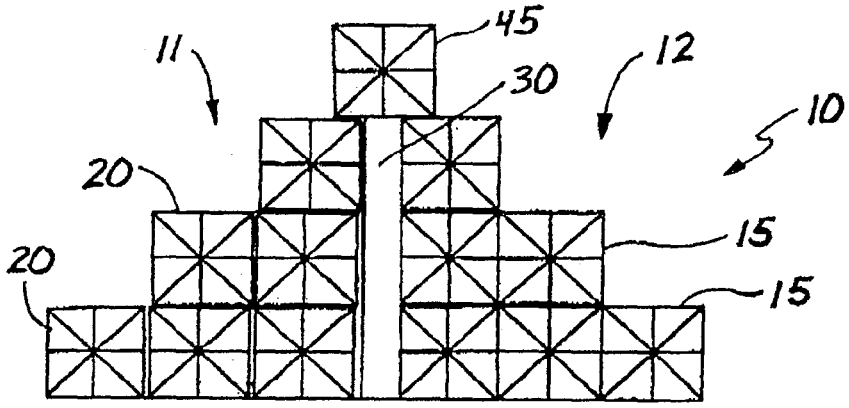
FIG. 1
FIG. 2
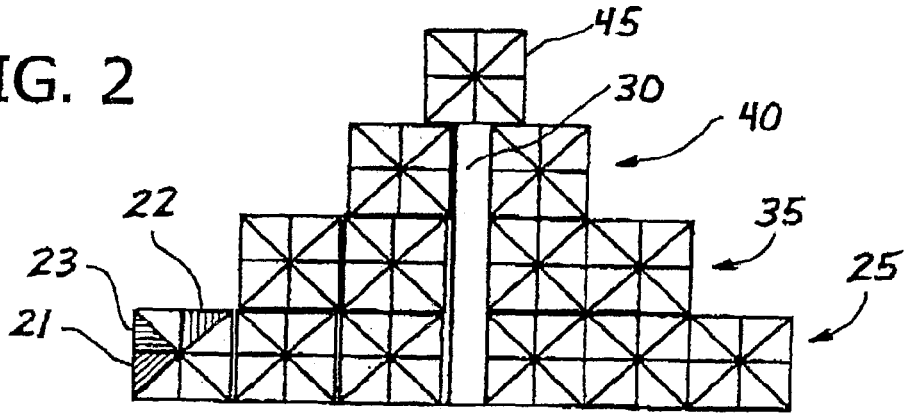
FIG. 3
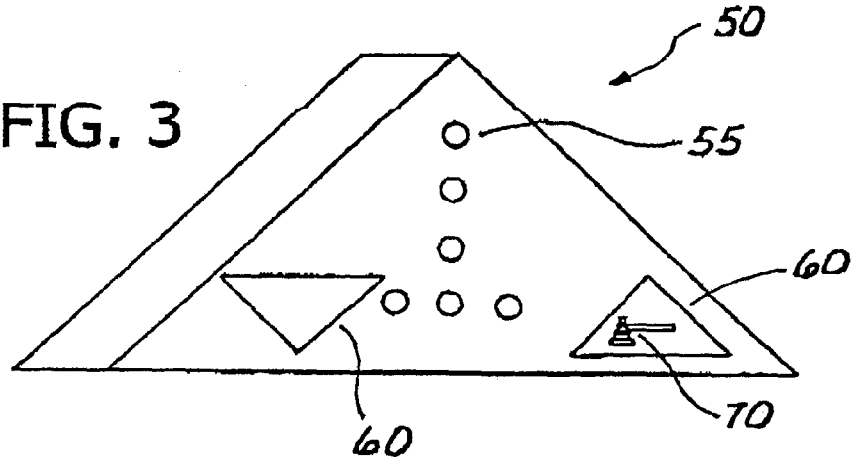

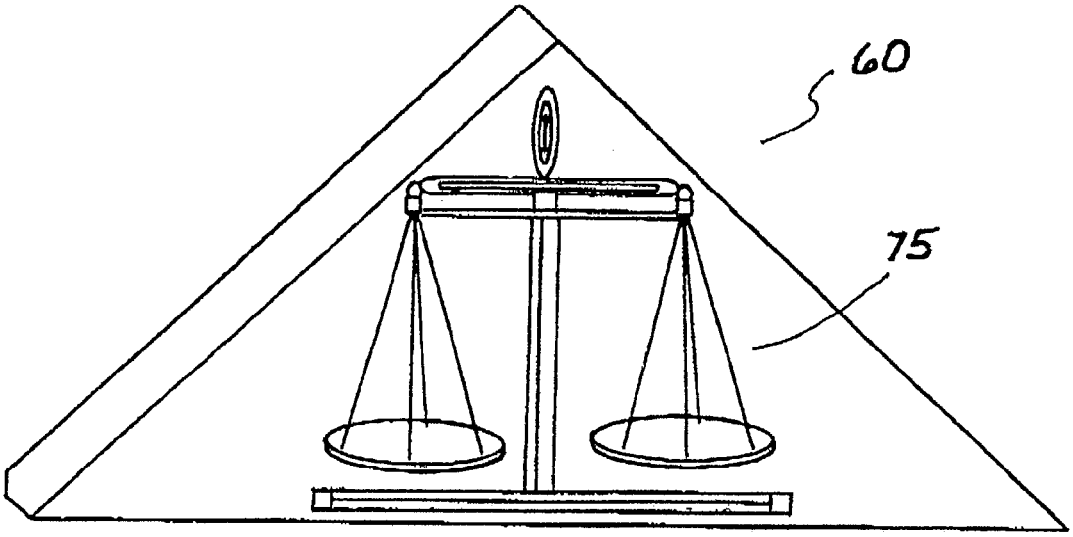
FIG. 5
FIG. 4
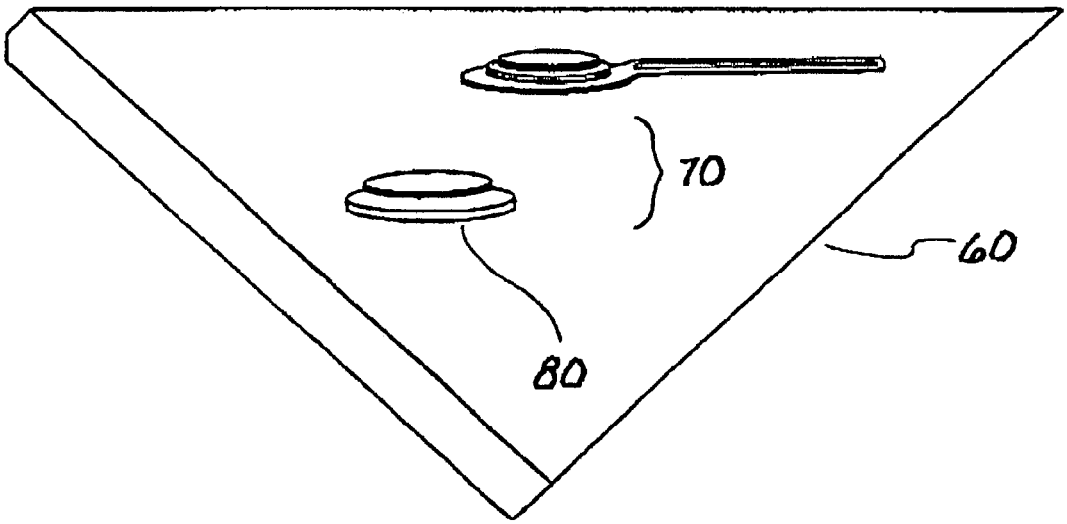

BOARD GAME AND METHOD OF PLAY

CROSS REFERENCE TO RELATED APPLICATIONS

This application is a continuation-in-part of application Ser. No. 10/124,058 filed Apr. 15, 2002, now U.S. Pat. No. 6,572,109 which is a continuation-in-part of application Ser. No. 09/455,335 filed Dec. 6, 1999, now abandoned.

FIELD OF THE INVENTION

The present invention relates to a board style game. More particularly, a three-dimensional board game, formed by individual blocks, challenges players or teams of players to reach a zenith or summit thereof. Players advance toward the zenith by correctly answering pre-established questions preferably designed to illicit the players' reasoning skills.

BACKGROUND OF THE INVENTION

Although the present invention may be played using any set of questions, preferably a game of the present invention seeks to teach teenagers the ability to reason and ultimately make the right choices under various situations. The game itself includes a plurality of blocks which when combined form a triangular structure. The triangular structure has two halves defined by a vertical elongated member. A single block defining the zenith rests on top of the elongated vertical member and represents the goal for each player or team to accomplish. The two halves represent two players or two teams. Viewable faces of the blocks can further be divided into a plurality of sections thereby facilitating teams with up to 64 players each.

Reaching the zenith is achieved by correctly answering questions based on pre-established scenarios. In addition, a second set of choices requires players to choose the area of law, or other subject matter, related to the question previously posed. Based on the answers selected to both the scenario question, and the related area of law question, players either advance toward the zenith or remain at a particular step. The questions are designed to illicit reasoning from teenage players.

Previous U.S. patents disclose board games based on players attempting to reach a summit or zenith. However, the games do not include the novel features included in the present invention.

U.S. Pat. No. 4,147,359 (the '359 patent) to King describes game equipment having steeped ramp means. The game equipment is simple and ascending to the top of the ramp is accomplished by a spinner in combination with three decks of cards having background information and questions based thereon. The equipment does not have individual blocks, does not incorporate means for multiple-player teams and relies heavily on luck rather than reasoning to deduce a correct answer selection.

U.S. Pat. No. 5,004,245 (the '245 patent) to Schumacher et al., describes a board game in the form of a multi-level pyramid. The game is based on dice and their arbitrary outcomes. The '245 patent is not based on reasoning to deduce a correct answer selection nor does the game include means for multi-player teams to participate.

U.S. Pat. No. 5,660,388 (the '388 patent) to Benn describes a three-dimensional board game which is again in the form of a multi-level pyramid. The game protected by the '388 patent operates in a manner similar to chess or checkers in that the players take turns moving pieces until each player removes all his or her pieces from play. The game pieces are removed from play once the piece reaches the central space atop the pyramid lay out. Unlike the present invention the game is not based on reasoning to deduce a correct answer selection and does not include means for multi-player teams to participate.

The shortcomings of the aforementioned patents are overcome by the present invention. The blocks of the present invention include means for multi-player teams to challenge one another. Achieving victory is accomplished once each player of a team reaches the zenith. In other words, each player of a team must successfully traverse the triangular structure, by answering questions designed to challenge one's reasoning skills, until the zenith is reached. Moreover, the previous game boards do not include illumination means for displaying a game status.

SUMMARY OF THE INVENTION

The present invention accomplishes its desired objects by providing a three-dimensional triangular game board, comprised of individual blocks, which players are challenged to reach the zenith or summit thereof. The blocks are arranged on either side of a vertical elongated member. The elongated member divides the triangular board into two sections-one section each for opposing players or teams of players. The number of blocks on each side of the elongated member can be any number, but it is preferred that the base on each side have at least three blocks. A block denoting the zenith of the structure straddles the vertical elongated member such that one-half of the block is on the side of one player or team and the other one-half is on the side of the other player or team. In other words, each team is climbing to the zenith denoted by a common block.

To permit multi-player teams, viewable surfaces of the blocks are divided into identical sections equal to the number of players on each team. By way of example, the surface of the block may be divided into two, four, eight, sixteen, thirty-two and even sixty-four players per team. To further differentiate the sections associated with each player, the sections are illuminated in distinct color patterns so that each player has a corresponding section and color.

The illumination of the block sections permits each player's progress to be tracked accordingly. While not shown, means of illumination are preferably implemented with fiber optic technology. Fiber optic technology provides a means for producing a maximum number of colors and therefore the maximum number of players. Moreover, fiber optic technology does not require a great deal of space or energy to operate.

A game pad and team symbol displays operate in conjunction with the triangular game board. The game pad, also triangular in shape, provides a means for players to input responses to the scenario questions and area of law questions. Preferably, the means for inputting the answers is in the form of buttons in electrical communication with a microprocessor and a storage file containing a library of answers and point values corresponding thereto. The pad and/or microprocessor are also in electrical communication with said fiber optical technology causing the player's designated section to illuminate thereby tracking each player's status and each teams' status simultaneously on at least one viewable face of the blocks.

Preferably, the pad is triangular and arranged such that four buttons are aligned vertically for answering the scenario questions and three buttons, including the bottom vertical button, are arranged horizontally near the base of the triangular-shaped pad for answering the area of law questions. In this manner, the bottom button of the vertical arrangement is also the middle button of the horizontal arrangement. Preferably, the buttons are illuminated to correspond to the color corresponding to the player responsible for answering the question being posed. Preferably, the game pad is also in communication with a timer set to a pre-defined time limit (e.g. 3 seconds) such that players must respond quickly as well as accurately.

The game pad also includes two areas for displaying each team's game symbol. Although the team symbols can take many forms, it is preferred that a gavel and scales are displayed. The gavel and scales record the status of each team's progression toward the zenith. Both the gavel and scales are initially displaced from an equilibrium position by a degree related to the number of movements required to reach the game's zenith. In other words, should six movements be required to reach the zenith, the gavel and scales will begin six movements from equilibrium. Equilibrium is preferably balanced scales and a gavel at rest on a base.

In a computer embodiment, a computer processor in communication with a display facilitates the playing of the embodiments of the present invention. As is well known in the art, games and the like may be played on a computer (e.g. personal computer, gaming machine, etc.) in a two-dimensional environment. More particularly, in the computer embodiment, the computer processor is programmed to control the operation of the games of the present invention. Alternatively, the games of the present invention may be stored on a CD or other computer storage means and then read by a computer or computer network. Players are provided with one or more interfaces to respond to, and instruct, the processor with respect to play of the games. Said interfaces may include a touchscreen, a keyboard, a wand or a mouse. Any means for permitting the players to interact with the processor are suitable for the computer embodiment of the present invention.

In the computer embodiment, the physical objects related to the disclosed games are displayed on a display. The display may be a cathode ray tube, a plasma display, a projection display or any other display capable of displaying the objects of the games. Thus, the triangular game board and the individual blocks having viewable surfaces divided into identical sections equal to the number of players on each team are displayed on the display. Additionally, the computer can display other game board configurations, including a triangular game board comprised of individual circular members instead of blocks. Further, in the computer embodiment the processor controls the illumination of the block or circular sections thereby permitting each player's progress to be tracked accordingly.

While players may continue to rely on the game pad, now in communication with the processor of the computer or the like, it is contemplated that players will rely on the touchscreen, the keyboard, the wand or the mouse to communicate with the computer processor. For example, the processor causes the question to be displayed and the player is then given the opportunity to input a response via the game pad or the desired interface. The timer may also be displayed on the display so that players are made aware of the time remaining for a response to be input.

The computer embodiment provides numerous benefits that the physical embodiments cannot. For example, the computer embodiment is much more versatile and can be transported with ease. Moreover, a majority of people understand, and are familiar with, the basics of computers and therefore can quickly participate in the games of the present invention. Additionally, the massive storage capabilities and the tremendous graphics of today's computers provide an unlimited library of questions and visual displays for implementing the games.

Very importantly, a system of networked computers (e.g., the Internet) allows players in different locations to participate in the same game. Therefore, multiple players have the opportunity to access a website offering the games of the present invention and may create teams with players remotely located from one another. In such an arrangement, one or more servers may be used to control the play of the game. The servers house processors that function in a similar fashion to the computer processors that control the game played on a single PC computer.

Game questions can be based on any topics or subject matter, but preferably the questions are related to scenarios that teenagers often find themselves involved. For instance, the questions may read as follows:

> A new friend invites you over to his uncle's motor home to watch and play games. You accept the invitation and when you arrive you notice that the gate leading to your new friend's RV is locked. Your friend assures you that his uncle left the RV unlocked and all you have to do is jump a four foot fence. What do you do?

Based on the presented scenario four answers are available as follows:

A) It makes sense, you decide to jump the fence;

B) You hesitate until you observe your friend jump the fence and open the door to the RV;

C) You refuse and tell your friend you want to see his uncle unlock the gate; or D) You hate jumping fences and go home.

Each answer has a point value associated therewith. In the instant example, answer A is worth (−2 points), answer B is worth (−1 points), answer C is worth (+2 Points) and answer D is worth (0 points). Once the player has selected an answer, the player is provided with two or more possible area of law choices with which the question relates. Continuing with the instant example the choices may be as follows:

1. Destruction of private property;
2. Breaking and entering; or
3. Unlawful entering.

Answering the area of law question correctly, may advance a player even more if the subject matter question was answered correctly, or may negate an incorrect answer to a subject matter question.

BRIEF DESCRIPTION OF THE DRAWINGS

FIG. 1 shows a front view triangular game board of the present invention;

FIG. 2 shows the front view of the triangular game board with certain sections illuminated and colored (shown in hatching);

FIG. 3 shows a triangular game pad of the present invention; and

FIG. 4 shows a team player symbol in the form of a gavel displaced from equilibrium; and FIG. 5 shows a team player symbol in the form of scales at equilibrium.

DESCRIPTION OF THE PREFERRED EMBODIMENT

As shown in FIG. 1, a triangular game board, generally designated as by the numeral 10, includes a plurality of game blocks 15. Each game block 15 includes an identical number of equal-sized sections 20 depicted on at least one viewable face thereof. At least the viewable faces of the game blocks 15 are transparent such that light can pass partially therethrough. An elongated vertical member 30 separates the triangular game board 10 into two equal sides 11 and 12, one for each player or team. A game block 45 placed at the zenith of the game board 10 represents the goal of an underlying game utilizing the game board 10.

One of each equal-sized sections 20 per block 15 corresponds to a designated game player. In other words, each game player is assigned the same section 20 on each block 15 of the side 11 or 12 corresponding to the player's team. Each section 20 includes means for illuminating the section 20 in a unique color associated with each game player. FIG. 2 shows the game board 10 with sections 21, 22 and 23 illuminated and distinctly colored (shown as unique hatching). The illumination and color combination indicates the level that each player has progressed towards the zenith. The exact path to the zenith may be varied, but the path must be accomplished level by level. Therefore, a player must first traverse a base level 25 of blocks 15 prior to moving to the second level 35 and third level 40 of blocks 15 and onto the zenith block 45.

The means of illumination is preferably based on fiber optic technology. Fiber optic systems use little space and can project numerous colored light schemes. Therefore, the number of sections 20 provided on each block 15 can be maximized for permitting a large number of players per team.

FIG. 3 illustrates a triangular game pad 50 having answer input means in the from of push buttons 55 and two team symbol displays 60. The game pad 50 is in electrical communication with the means for illuminating the sections 20 such that based upon a correct or incorrect answer, the progression of the players can be depicted, through illumination and color of sections 20, on the at least one viewable face of the game blocks 15. Moreover, the game pad 50 is in communication with a microprocessor or the like and a storage device (e.g. computer memory) such that the players' inputted answers can be scored properly and quickly. The microprocessor is preprogrammed to score the inputted answers based on the information stored in the integral or remote storage device. In addition, the microprocessor preferably controls the means of illumination and the team player symbols. Such use of a microprocessor and memory (storage) is well known in the art and not described in detail herein.

The push buttons 55 are arranged such that the four vertical buttons are used to input answers to scenario questions and the three horizontal buttons are used to input answers to area of law questions. It is preferred that the colors of the buttons 55 change to correspond to each player's section 20 color. Moreover, a timer (not shown) in communication with said microprocessor is pre-set to a particular time limit (e.g. 3 seconds) during which players must input answers to the posed questions. Failure to input an answer in the allotted time limit may include neutral or negative game consequences.

The game pad 50 further includes a display 60 for each team's symbol. The team symbols are preferably in the form of a gavel 70 and scales of justice 75. The gavel 70 and scales of justice 75 provide a means for checking the status of the game for each team, more particularly each player. FIGS. 4 and 5 show the gavel 70 and scales 75 respectively. The gavel 70 of FIG. 4 remains one or more movements from equilibrium. At equilibrium the gavel 70 rests on its base 80. FIG. 5 shows the scales 70 at equilibrium (i.e. balanced) as described above.

Although the underlying game utilizing the disclosed triangular game board 1 and game pad 50 can take any form, the following envisioned rules disclose a preferred methodology of the underlying game:

Rules:

Each team is divided according to age. Odd numbers 13, 15, 17, and 19 represent one team, while even numbers 12, 14, 16, and 18 represent another team. The decision is arbitrary, but once selected may not be changed. The age of the players must be twelve to nineteen years of age.

Each team is represented by a gavel or scales symbol. Players must choose sides. Each team is also provided with a fixed set/number of colors and a single color may not be represented twice within each team.

A single player is preferably composed of opposites, a male and a female, but may be considered an individual. A balance of ratio, however, must be made within each team before proceeding with the game. Players must listen carefully to the scenarios, options and the descriptions of the laws being described. At the of the last description a choice must be made. Nothing will be repeated.

Each question asked is divided into two parts; a situation/scenario and the identification of the law violated. Part one describes a scenario and is followed by four options where the points and penalties are tabulated on an individual basis. Tabulations are based on the real number line using basic algebraic addition. Part two requires identification of one of three keyed points of law; unlawful entry, breaking and entering, destruction of private property, etc. As defined above, penalties are fixed but the correct identification may advance the player or neutralize the previous poor decision.

Should the entire team answer either question correctly, that team will receive an additional fixed number of points per player.

In the event of a tie between players on opposing teams at the zenith, a new scenario is described followed by the corresponding law identification and points are tabulated. Procedure may be repeated until the tie is broken.

The set of rules presented herein is but one possible example of one set of rules presented to further illustrate the use of the triangular game board. The ultimate rules chosen can take any form without departing from the spirit and scope of the present invention.

The games of the present invention may also be played on a computer or a computer network as described above. Since it is well known in the art to play games on computers, the intricate details need not be disclosed herein.

Although the invention has been described in detail with reference to a preferred embodiment, additional variations and modifications exist within the scope and spirit of the invention as described and defined in the following claims.

I claim:

1. An electronically implemented game comprising:

a processor;

a display in communication with said processor;

said display displaying a plurality of block-like structures arranged to form a generally triangular shape, said block-like structures having at least one viewable face, each said viewable face divided into a plurality of equal sections corresponding to a number of game players;

means for uniquely identifying said sections; and one or more interfaces between said game players and the processor.

2. The game according to claim 1 wherein said means of uniquely identifying said sections is accomplished by displaying unique colors within each section.

3. The game according to claim 1 wherein said means of identifying said section is used to monitor a game status.

4. The game according to claim 1 wherein said one or more interfaces facilitate the input of responses to game questions.

5. The game according to claim 1 wherein said processor automatically scores the game.

6. The game according to claim 1 further comprising a storage means for storing game information.

7. The game according to claim 1 wherein said processor controls the identification of said sections.

8. The game according to claim 1 wherein game questions are related to hypothetical situations which players may encounter in real life.

9. The game according to claim 8 wherein said hypothetical situations are based on multiple scenarios and include at least two possible responses.

10. The game according to claim 9 wherein each selected response to a question corresponds to a different score.

11. The game according to claim 1 wherein each game player is assigned an individual section on each block-like structure, said individual section being identified to track the progress of the corresponding player.

12. The game according to claim 1 wherein the one or more interfaces include a mouse, a touchscreen, a wand or a keyboard.

13. The game according to claim 1 wherein the display further displays a question response timer.

14. A method of playing an electronic game on a computer with two teams whereby the goal is to reach a zenith of a displayed triangular game board comprising:

displaying a plurality of block-like structures arranged to form a generally triangular shape, said block-like structures having at least one viewable face, each said viewable face being divided into a plurality of equal sections corresponding to a number of game players;

providing a means for uniquely identifying said sections;

providing one or more interfaces between game players and said computer;

individually questioning players of the teams, said players using said one or more interfaces to input responses to said game questions; and said computer advancing, retreating, or holding constant a player's position based on the player's responses.

15. The method of playing a game according to claim 14 wherein said questioning is related to hypothetical situations which players may encounter in real life.

16. The method of playing a game according to claim 15 wherein said hypothetical situations are based on multiple scenarios and include at least two possible responses.

17. The method of playing a game according to claim 14 wherein said means of uniquely identifying said sections is used to monitor a status of the game.

18. The method of playing a game according to claim 14 wherein each game player is assigned an individual section on each block-like structure, said individual section being identified to track the progress of the corresponding player.

19. The method of playing a game according to claim 14 wherein the one or more interfaces include a mouse, a touchscreen, a wand or a keyboard.

20. The method of playing a game according to claim 15 wherein the display further displays a timer.

21. A computer implemented game comprising:

a processor;

a display in communication with said processor;

said display displaying a game board;

said processor causing said display to present game players with game questions, said game questions being related to hypothetical situations, having multiple scenarios, which players may encounter in real life; and said processor advancing, retreating or holding constant a player position on the game board in response to said player's response to the game question.

22. The game according to claim 21 wherein said game questions each have at least two responses to choose from, each said at least two responses having a different point value.

23. The game according to claim 21 wherein said game questions have four response to choose from, each said response having a different assigned point value.

24. The game according to claim 23 wherein one response has a negative point value assigned thereto thereby causing a player to retreat on the game board.

25. The game according to claim 21 wherein the game board is triangular shaped.

* * * * *